US005147277A

United States Patent [19]

Shapiro

[11] Patent Number: 5,147,277

[45] Date of Patent: Sep. 15, 1992

[54] POWER-EFFICIENT LIQUID-SOLID SEPARATING CENTRIFUGE

[75] Inventor: Ascher H. Shapiro, Jamaica Plain, Mass.

[73] Assignee: Baker Hughes Incorporated, Houston, Tex.

[21] Appl. No.: 671,579

[22] Filed: Mar. 19, 1991

[51] Int. Cl.[5] ..... B04B 1/20

[52] U.S. Cl. ..... 494/53; 210/374; 210/378

[58] Field of Search ..... 210/512.1, 787, 360.1, 210/380.1, 380.3, 781, 360.2, 374, 378, 379; 494/52, 53, 54, 56, 57

[56] References Cited

U.S. PATENT DOCUMENTS 3,423,015 1/1969 O'Conor ..... 233/7
3,623,656 11/1971 Lavanchy ..... 494/53
4,950,219 8/1990 Luchetta ..... 494/53

FOREIGN PATENT DOCUMENTS 2901607 1/1979 Fed. Rep. of Germany .
2088255 6/1982 United Kingdom .

*Primary Examiner*—Robert A. Dawson
*Assistant Examiner*—Matthew O. Savage
*Attorney, Agent, or Firm*—Carl A. Rowold

[57] ABSTRACT

A power-efficient liquid-solid separating centrifuge is disclosed which has power recovery apparatus on the bowl-head of a rotary bowl including a plurality of liquid flow passageways in fluid communication with transfer ports in the bowlhead of the rotary bowl for receiving liquid separated from the slurry introduced into the rotary bowl. These passageways are configured and arranged to direct the flow pattern of the liquid exiting the liquid transfer port to discharge at a radially inward position relative to the liquid transfer port and to flow in a direction with a reduced velocity component in the direction of the rotation of the rotary bowl, thereby recovering power previously expended to accelerate the feed slurry.

10 Claims, 5 Drawing Sheets

POWER-EFFICIENT LIQUID-SOLID SEPARATING CENTRIFUGE

BACKGROUND OF THE INVENTION

This invention relates to liquid-solid separation equipment, and more particularly to liquid-solid separating centrifuge apparatus comprising a rotary bowl which is spun at a relatively high rate of speed (500 RPM or more) to effect centrifugal separation of the liquid and solid phases present in a slurry delivered to the centrifuge.

Reference is made to U.S. Pat. No. 4,381,849, disclosing prior art liquid solid separation centrifuge equipment. This equipment comprises a rotary bowl of generally cylindrical configuration having a generally conical end extension at one end thereof and a bowl-head at the other end thereof. A rotary conveyor is mounted coaxially in the bowl and a motor and gear train are provided for rotating the bowl and the conveyer about a common axis in the same direction, but at different speeds of rotation. A solid-liquid slurry is delivered to the bowl and is collected in a pool of slurry adjacent the cylindrical inner surface of the bowl. Centrifugal force causes the slurry held in the pool to separate into its liquid and solid phases with the heavier phase (i.e., the solids) migrating radially outwardly toward the surface of the bowl. The solids are transported axially along the bowl by the screw conveyor to a solids discharge port in the conical end extension. The liquid phase that has been separated from the slurry migrates to the radially inward free surface of the pool and is withdrawn via liquid transfer ports in the bowl-head. A plurality of weir plates (one for each transfer port) partially cover radially outer portions of the ports for directing the flow of overflow liquid through the radial inner portion thereof.

Inasmuch as the rotary bowl is rotating at a speed of 500 RPM or more, the overflow liquid (which thus has a linear circumferential speed of several hundred feet per second), after flowing through the transfer ports and past the weir plates, exits as a series of streams having a significant angular velocity component in the direction of rotation of the bowl. In other prior art centrifuges, an annular weir plate defining a single, continuous annular chamber is provided, such that the overflow liquid is discharged in a circumferentially continuous annular flow pattern having a significant tangential concircumferential velocity component. If the pool in the bowl becomes so deep as to cause flow of liquid through the transfer port, the flow in an annular chamber without baffling, can assume a free-vortex flow pattern, such that the tangential speed of the liquid upon discharge can exceed that of the bowl at this same radius. This phenomenon may be visualized by considering the vortex flow pattern of water created when a toilet is flushed, and the water exiting the central area of the outlet flows at an increased speed so as to conserve angular momentum. Regardless of which of these flow patterns may exist, in the prior art centrifuges, the overflow liquid discharges with significant tangential velocity and associated angular momentum which previously has been imparted within the rotating bowl, with resultant significant energy loss in the discharged overflow liquid. This lost energy becomes more significant as the speed of rotation of the centrifuge and/or the diameter of the rotary bowl is increased. For large, high speed centrifuges (especially in thickening applications) the lost energy of the overflow liquid can represent up to 80% of the power input required to operate the centrifuge.

SUMMARY OF THE INVENTION

Among the several objects of the invention may be noted the provision of an improved liquid-solid separation centrifuge having reduced energy consumption demands; the provision of such apparatus in which the angular velocity and resultant lost energy of the overflow liquid is significantly reduced; the provision of such apparatus which redirects the flow of the overflow liquid in a direction that prevents the creation of a free-vortex flow pattern; and the provision of such apparatus which is capable of being operated with a deeper pool of slurry for a greater degree of separation of the liquid and solid phases.

In general, the liquid-solid centrifuge apparatus of this invention comprises a rotary bowl of generally cylindrical configuration having a frusto-conical end extension at one end thereof and a bowl-head closing the other end. It further comprises a rotary conveyor mounted coaxially in the bowl with drive means for rotating the bowl and conveyor about their common axis in the same direction but at different speeds of rotation. Liquid-solid slurry is fed into the bowl via supply means. A solids discharge port in the frusto-conical end receives a flow of solids separated from the slurry for discharge away from the bowl, and at least one liquid transfer port in the bowl-head receives a flow of the liquid separated from the slurry for exit from the bowl. These liquid transfer and solid discharge ports are positioned radially inwardly of the cylindrical surface of the bowl between the ports so as to define an annular surface for holding a pool of slurry for separation into the liquid and solid phases upon rotation of the bowl. A weir is provided on the bowl-head which defines at least one liquid flow passageway in fluid communication with the liquid transfer port and extends to an outlet positioned radially inwardly of the liquid transfer port. This passageway is configured and arranged to direct the liquid exiting the liquid transfer port to discharge the outlet at a radially inward position relative to the liquid transfer port and to flow in a direction with a reduced velocity component in the direction of rotation of the bowl. This enables both the circumferential angular velocity (and the associated linear circumferential velocity) of the overflow liquid as it discharges from the outlet and the resultant lost energy of the discharged overflow liquid to be reduced, thereby recovering power previously expended to accelerate the feed slurry.

Other objects and features will be in part apparent and in part pointed out hereinafter.

BRIEF DESCRIPTION OF THE DRAWINGS

Corresponding reference characters indicate corresponding parts throughout the several views of the drawing.

DESCRIPTION OF THE PREFERRED EMBODIMENTS

Figure 1:
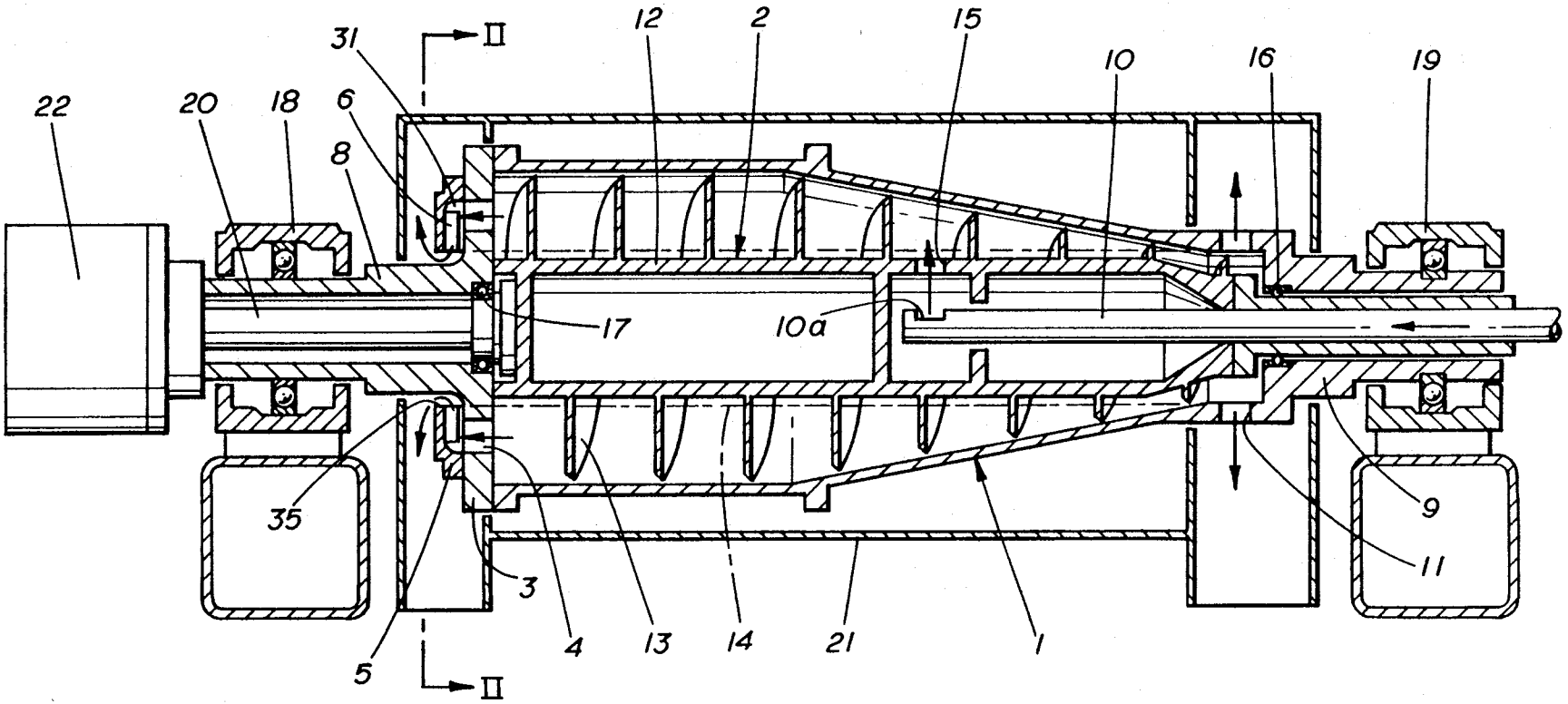
FIG. 1 is a vertical section of the liquid-solid separation centrifuge of this invention.

Referring to FIG. 1, there is shown a liquid-solid separating centrifuge of this invention comprising a rotary bowl 1 of generally cylindrical configuration having a frusto-conical end extension 9 at one end thereof. The bowl further has a bowl-head 3 closing the other end of the bowl. A rotary screw conveyor 2 is mounted for rotation coaxially in the bowl. A tubular projection extends from the frusto-conical end extension 9 and is rotatably mounted in bearing stand 19. Similarly, the bowl-head 3 includes a tubular portion 8 extending axially thereof, which is rotatably mounted in bearing stand 18. The screw conveyor 2 includes screw blades 13 extending helically around a tubular core 12 of the conveyor. Projecting axially from one end of the tubular core 12 is a tubular member received in the frusto-conical end extension of the bowl and rotatably mounted for rotation relative therewith via bearing member 16. A drive shaft 20 extends from the other end of the tubular core 12 of a conveyor and is mounted for rotation relative to the bowl-head 3 via bearing member 17.

Means, such as motor and gear train 22, is provided for rotating both the bowl (via the tubular portion 8 of the bowl-head) and the screw conveyor (via drive shaft 20) about a common axis of rotation in the same direction, but at different speeds of rotation. This provides a differential speed between the bowl and the screw conveyor for enabling the screw conveyor to advance solid materials present in the bowl toward the frusto-conical end of the bowl. A slurry of liquid and solid is delivered to the interior of the screw conveyor and the bowl via supply pipe 10 having an aperture 10*a* in register with an inlet port 15 in the tubular core 12 of the screw conveyor. As best illustrated in FIG. 1, slurry delivered to supply pipe 10 exits the pipe via aperature 10*a* and flows through inlet port 15 into the interior of the rotating bowl.

Solids discharge ports 11 are provided in the frusto-conical end extension 9 of the bowl for receiving and discharging the solid phase separated from the slurry delivered to the bowl. Similarly, liquid transfer ports 4 are provided in the bowl-head 3 for receiving and discharging the liquid phase separated from the slurry. These ports are positioned radially inwardly of the interior surface of the cylindrical bowl 1 extending axially between them to define an annular surface in the bowl for holding a body of slurry for separation upon rotation of the bowl. This body of slurry is generally known as a so-called "pool" represented at 14 in FIG. 1. Upon supply of slurry to the bowl, the entering slurry collects in the pool 14 and is subject to centrifugal force tending to cause the relatively dense solid particles or solid phase to separate from the relatively light liquid phase of the slurry. In this separation process, the solid phase migrates radially outwardly under the centrifugal force toward the surface of the bowl and is transported axially toward the solids discharge port via the screw conveyor 2 rotating within the bowl. At the same time, the liquid phase is displaced and migrates radially inwardly toward the inner radial free surface of the pool 14 and is withdrawn from the bowl via transfer ports 4 at the bowl-head.

Figure 3:
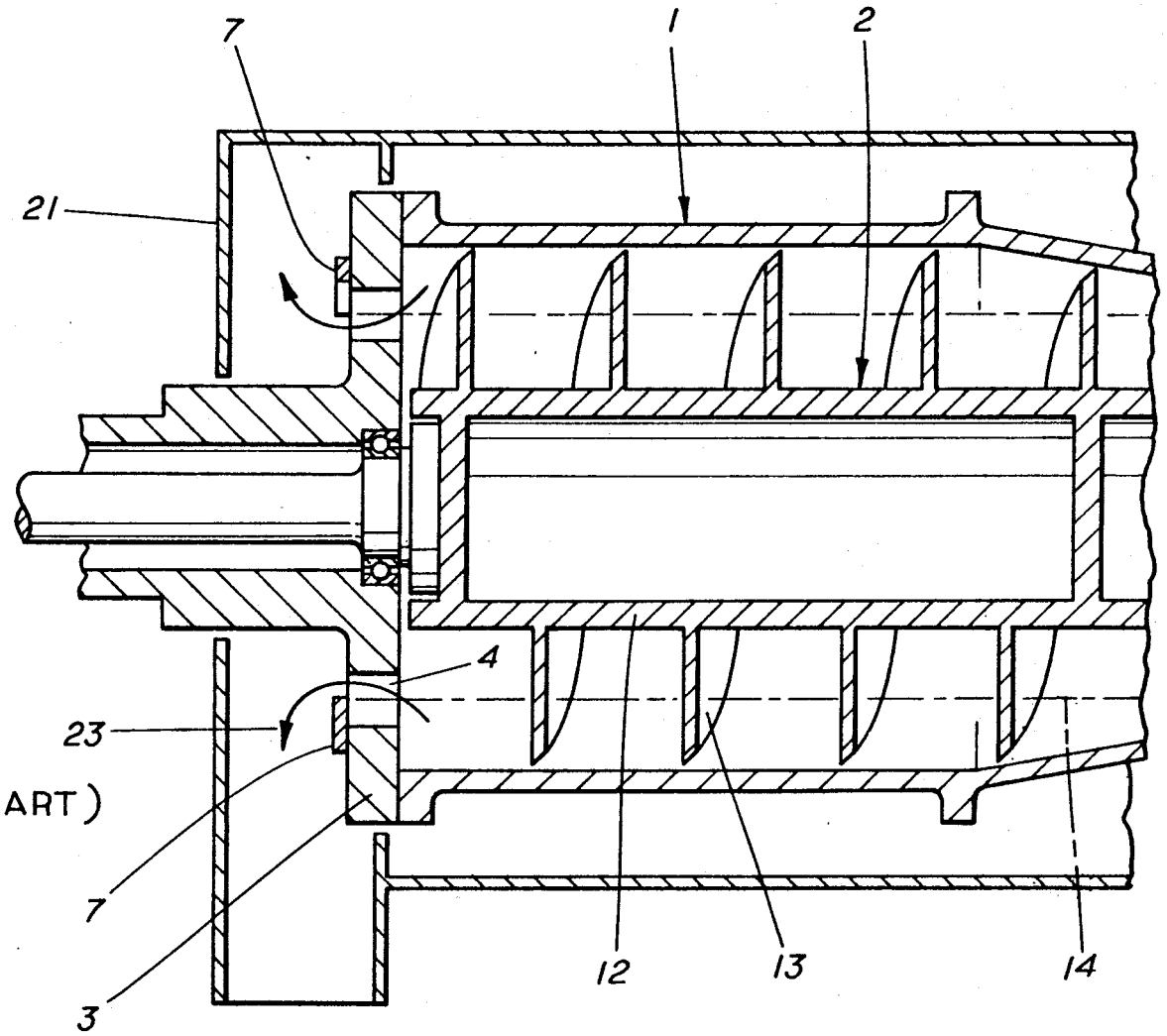
FIG. 3 (PRIOR ART)
FIG. 3 is a partial vertical section of a prior art centrifuge illustrating the case of a flow pattern having a significant angular velocity component assumed by the overflow liquid as it discharges the liquid overflow ports in the bowl-head.

Referring now to FIG. 3, there is shown a cutaway view of a portion of a prior art centrifuge. In this prior art device, the overflow liquid withdrawn from the bowl exits the ports 4 and assumes a flow pattern as depicted by the arrows 23 and flows past the weir plates 7 (one for each port 4) and is discharged in a plurality of streams each having a large angular velocity component in the direction of rotation of the bowl. As described earlier, some other prior art devices utilize a single, annular weir plate without baffles. If the pool such as pool 14 is kept shallow in such prior art centrifuge, the discharged overflow liquid on exit assumes a continuous annular flow pattern having a significant angular velocity component. However, if as described on page 2 the pool 14 is allowed to become deep enough for flow of liquid through the transfer ports 4, the discharged overflow liquid on exit assumes a free-vortex flow pattern exhibiting a greater rate of rotation than the bowl. Regardless of the discharge flow pattern, a significant angular velocity and energy are present in the discharged overflow liquid, which is lost to the system once the liquid is discharged. Indeed, the lost energy associated with the overflow liquid represents a significant portion of the overall energy demand necessary to operate a liquid-solid separation centrifuge. In large diameter, high speed centrifuges, especially in thickening applications, this lost energy may represent as much as 80% of the overall energy demands for the centrifuge.

Figure 2:
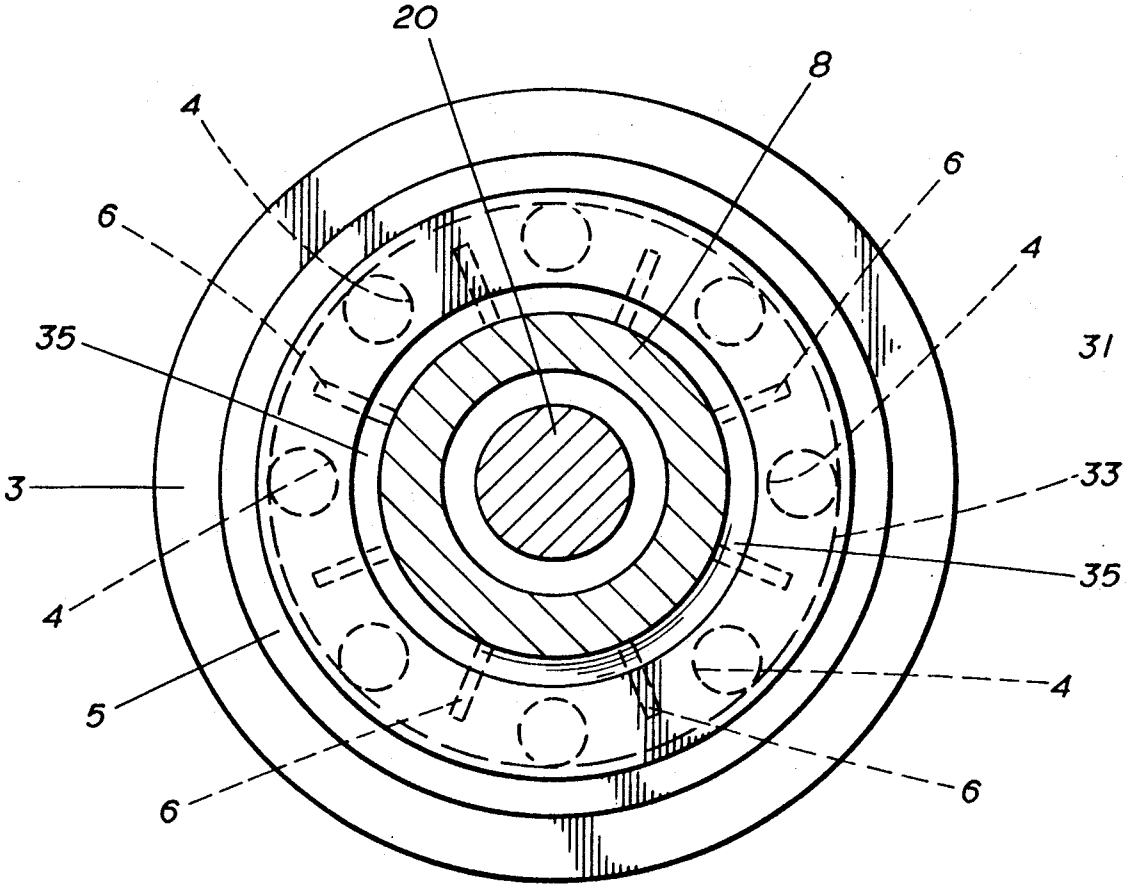
FIG. 2 is a radial section of the centrifuge on line II—II of FIG. 1.

Referring now to FIGS. 1 and 2, the improved overflow liquid discharge arrangement of this invention is illustrated. A ring-shaped weir member 5, constituting weir means, is mounted on the bowl-head 3 and defines an annular channel 31 between the weir member and the bowl-head which is in fluid flow communication with the ports 4 for receiving the overflow liquid. Positioned within this channel is a plurality of generally thin, planar vanes 6 at equally spaced intervals around the weir member extending generally in a radial direction for defining a plurality of passageways 33 that extend from an outer radial location at the ports 4 through an inner radial discharge location or outlet represented at 35. As shown in FIG. 1, the outlet 35 defines the height of the level of the pool 14. The passageways 33 are defined by sets of adjacent vanes 6 and are configured and arranged to direct the liquid exiting the liquid overflow ports 4 to discharge from the outlet 35 at a radially inward position relative to the liquid transfer port and to flow in a direction with a reduced velocity component in the direction of rotation of the bowl. The weir member 5 and vanes 6 prevent the overflow liquid from gathering additional angular velocity would otherwise occur in the annular weir channel 31 without such baffles. The baffling arrangement of vanes 6 thus prevents a free-vortex flow pattern of the overflow liquid relative to the weir member. The overflow liquid is discharged via outlets 35 at a radially inward location relative to ports 4 for reduced angular velocity. Moreover, the baffling function performed by the vanes 6 limits the speed of rotation of the overflow liquid on discharge to that of the bowl. Both of these factors contribute to a reduced angular velocity of the overflow liquid as compared to that present in the free-vortex flow pattern of the prior art, with the resultant lost energy of the discharged overflow also being reduced.

This reduction in lost energy of the discharged overflow liquid can be demonstrated and calculated mathematically as described hereinafter.

The linear circumferential velocity of the bowl-head at any point from the axis of rotation is represented by the formula $V=r\omega$, where V is the velocity as measured in feet per second, r is the radius of rotation as measured in feet, and $\omega$ is the speed of rotation as measured in radians per second.

Torque representing the change in angular momentum, or moment of momentum, of overflow liquid rotating with the bowl prior to discharge is represented by the formula, $T=(\rho Q/g_c)(Vr)$, where $\rho$ is the density of the overflow liquid as measured in pounds per cubic foot, Q is the volumetric flow rate of the overflow liquid as measured in cubic feet per second, $g_c$ is a gravity constant, which is 32.2 pound feet per seconds$^2$, and T is the torque as measured in foot pounds. Of course this equation is equally applicable to other units of measure.

In directing the overflow liquid to flow from the radial outwardly positioned port 4 to the radially inwardly positioned outlet 35, the overflow liquid applies a torque back to the rotary bowl in the direction of its rotation via the vanes 6, weir member 5, and bowl-head 3. The torque exerted on the vanes 6 by the overflow liquid during discharge as it flows from port 4 to discharge 35 is given by the formula, $$T_{bf}=\rho Q/g_c(V_4r_4-V_{35}r_{35}),$$

where $T_{bf}$ is the torque back force on the vanes, bowl-head and bowl. Because of vanes 6, the discharge fluid acts in a manner similar to solid-body rotation which is governed by the above-noted formula $V=r\omega$, so that the torque formula can now be converted to power as follows: $P_{bf}=T_{bf}=(\rho\omega Q/g_c)(V_4^2-V_{35}^2)$.

Inasmuch as $r_{35}$ is less than $r_4$, the torque defined by this formula is positive, indicating that energy and torque are extracted from the discharged overflow liquid as it flows from the ports 4 to the outlets 35. This extracted torque and energy are thus conserved, thereby reducing the power demands on the motor and gear train 22 in rotating the bowl at the desired rate of rotation.

Furthermore, by directing the flow stream at exit 35 in a direction opposite to the direction of rotation of the bowl, as described hereinafter, the circumferential velocity $V_{35}$ could further be reduced. In this case, both the recovered torque and power, respectively, can approach theoretically $$T_{bf}=(\rho Q/g_c)V_4^2$$

and $$P_{bf}=(\rho\omega Q/g_c)V_4^2$$

This power and torque savings does not necessitate discharging the fluid at "zero" radius as with the radial vane configuration of FIG. 1. Therefore, by a combination of radial and curved vane portions, the circumferential velocity at discharge will be minimized.

Figure 4:
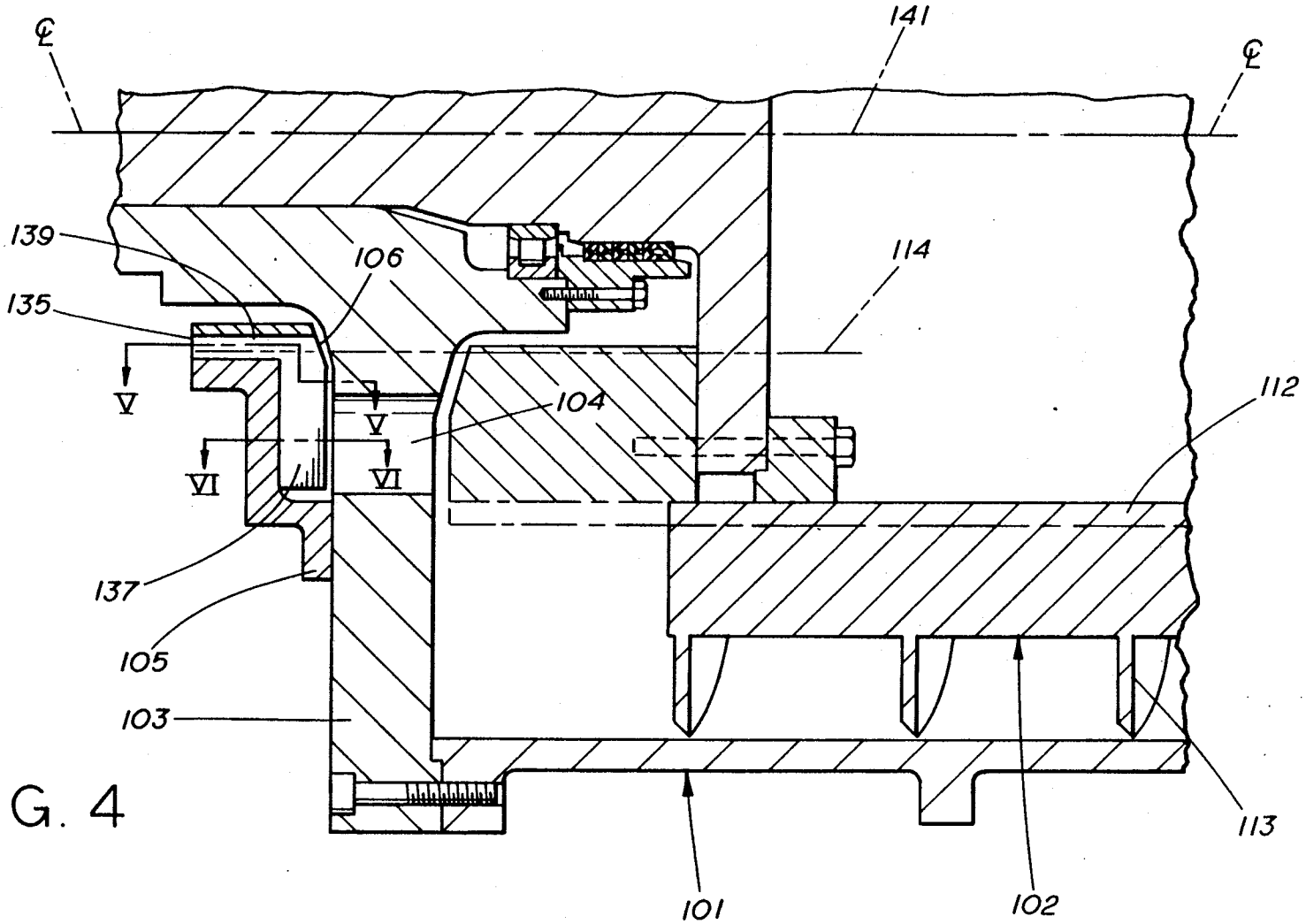
FIG. 4 is an enlarged vertical section of an alternative embodiment of the centrifuge of this invention illustrating weir means on the bowl head having curving vanes for reducing the speed of the overflow liquid.
Figure 6:
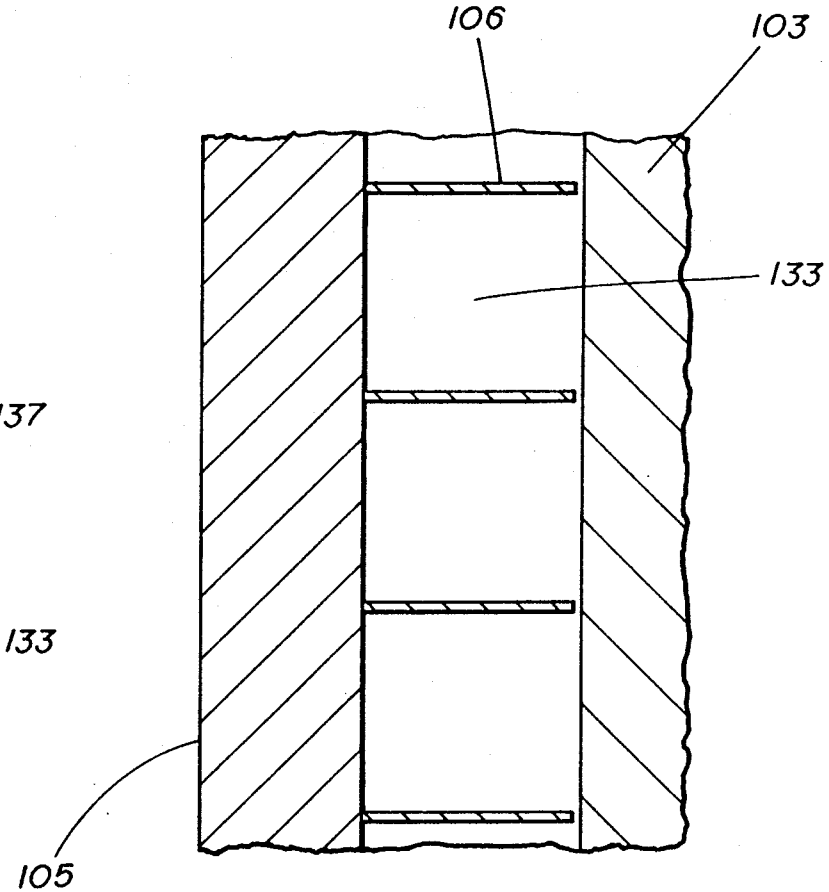
FIG. 6 is an enlarged section on line VI—VI of FIG. 4.
Figure 5:
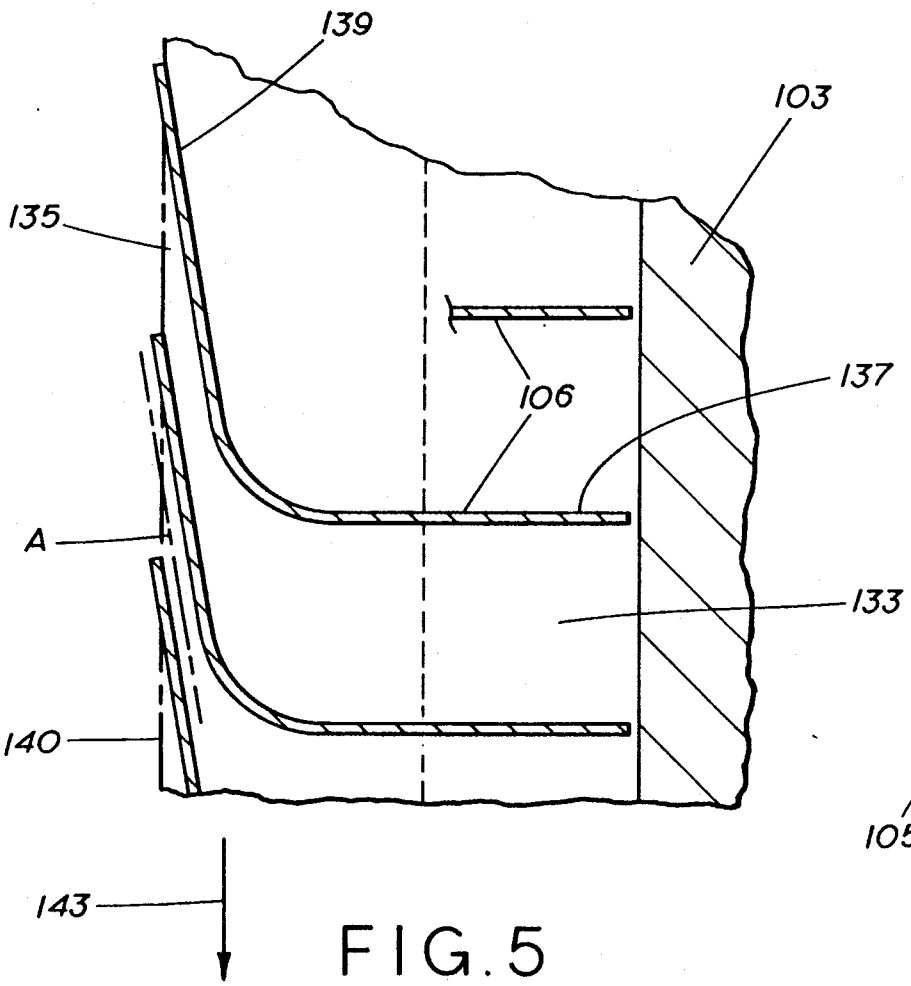
FIG. 5 is an enlarged section view on line V—V showing the weir and curved vanes.

Referring now to FIG. 4–6, there is illustrated an alternative embodiment of the centrifuge of this invention having the above-noted radial and curved vane portions. This centrifuge corresponds generally to the centrifuge 1 depicted in FIG. 1, in that it comprises a bowl 101, bowl-head 103, screw conveyor 102 having a tubular core 112 and screw blades 113, all of which are rotatable about a common axis 141. The bowl provides for a pool 114 of slurry to be held in the bowl and a liquid transfer port 104 for withdrawal of the liquid phase of the slurry from the pool. Weir means 105, in the form of a ring-shaped weir member carried on the bowl-head, directs the flow of the transfer liquid from the transfer port 104 to a radially inwardly spaced point of outlet 135. In this regard, vanes 106 are provided for directing the flow of the overflow liquid in a generally radially outwardly direction. In addition, these vanes, as described more fully hereinafter, further direct the flow of liquid in a direction generally opposite to that of the angular velocity of the bowl at the outlet 135 for further reducing the energy lost in the discharged overflow liquid.

Like the vanes 6, the vanes 106 are spaced at generally equal intervals around the weir member 105 and are preferably formed of thin sheet material. The vanes 106 have a radial outer portion 137 extending in a generally radial plane with respect to the axis of rotation of the bowl, and a radially inwardly portion 139 curved to extend in a circumferential direction. The radial inner portion 139 of the vanes extends at an acute angle A to a radial plane 140 of the bowl as shown in FIG. 5, and thus directs the overflow liquid to flow in a direction generally opposite to the direction of rotation of the bowl as represented by the arrow 143. Moreover, adjacent sets of blades which define the passageway 133 are so sized and arranged as to define cross-sectional areas of the passageway 133 such that the angular velocity of the overflow liquid as it exits the outlet 135 is generally equal in magnitude to the angular velocity of the bowl at the outlet. In this arrangement of blades, the cross- o sectional area for liquid flow associated with the radially outward portion 137 of the vanes is greater than that associated with the radially inward portion 139 of the vanes. This causes an increase in the speed of the liquid as it flows throughout the passageway to outlet 135. However, this velocity of the liquid is relative to the spinning bowl-head 3, so that the angular velocity of the discharged overflow liquid relative to the bowl-head is cancelled out by the angular velocity of the bowl-head itself at the outlet which is of generally the same magnitude but opposite direction. Relative to a stationary point, the discharged overflow liquid exiting from the weir means 105 presents little or no angular velocity. The change of the high speed angular velocity of the overflow liquid exiting the transfer ports 104 as it discharges from the outlet 135 permits a significant recovery of torque and energy recovery from the liquid as it is discharged. Indeed, it represents the recovery of a significant portion of the total angular velocity and energy of the overflow liquid which would otherwise be lost in the discharge flow pattern of prior art centrifuges.

It will be observed from the above that the two embodiments of the centrifuge of this invention will enable operation at reduced energy consumption levels, reduce the angular velocity and resultant lost energy of the discharged overflow liquid and prevent the creation of the free-vortex flow pattern of the prior art centrifuges thereby enabling the centrifuge of this invention to be operated with a deeper pool 14, 114 than otherwise possible. Deep pools are desirable in that they provide for an improved degree of separation of the liquid and solid phases from the slurry in the pool. With centrifuges of this invention it is possible to operate the centrifuge with a deeper pool for improved separation, while preventing the formation of free-vortex flow patterns and imposing lower energy demands on the drive and gear train arrangement.

In addition, while the weir means 5 is disclosed as having generally planar vanes 6 defining the passageways 33, other configurations are envisioned including those having vanes of non-planar construction and those having passageways therein defined by other means, such as passaging drilled in a solid weir member.

In view of the above, it will be seen that several objects of the invention are achieved and other advantageous results attained. As various changes could be made in the above constructions without departing from the scope of the invention, it is intended that all matter contained in the above description or shown in the accompanying drawings shall be interpreted as illustrative, and not in a limiting sense.

I claim:

1. A liquid-solid separating centrifuge comprising a rotary bowl of generally cylindrical configuration having a frusto-conical end extension at one end thereof and a bowl-head closing the other end thereof to define an interior space; said bowl-head defining an outer surface relative to said interior space; a rotary conveyor mounted co-axially in the bowl along a common axis; means for rotating said bowl and conveyor about their common axis in the same direction but at different speeds of rotation; means for feeding a solids-liquid slurry into said bowl; a solids discharge port in the frusto-conical end extension for flow of solids separated from the slurry away from the interior space; at least one liquid transfer port in and extending through the bowl-head for flow of liquid separated from the slurry away from the interior space; the cylindrical inner surface of the bowl between said ports defining an annular surface for holding a pool of slurry for separation upon rotation of the bowl, a weir fixedly attached on and rotatable with the bowl-head defining a plurality of liquid flow passageways and an outlet, said liquid flow passageway being in flow communication with the liquid transfer port and extending to said outlet for defining the height of the pool level, said outlet being positioned radially inwardly of the liquid transfer port relative to said common axis; said passageway being configured and arranged to direct the liquid exiting the bowl via the transfer port to discharge from the outlet at a radially inwardly position relative to the liquid transfer port and to flow with a reduced velocity component in the direction of the rotation of the bowl, thereby recovering power previously expended to accelerate slurry fed to the bowl; wherein said weir means comprises a ring-shaped weir member on the outer surface of the bowl-head having means defining a plurality of said liquid flow passageways therein, said means defining a plurality of said liquid flow passageways being fixedly attached to and rotatable with said ring shaped weir member.

2. The centrifuge of claim 1 wherein said means defining a plurality of said liquid flow passageways comprises a plurality of vanes, with each set of adjacent vanes defining in part one of said flow passageways.

3. The centrifuge of claim 2 wherein the vanes are positioned at equally spaced intervals around the ring-shaped weir.

4. The centrifuge of claim 2 wherein the vanes are formed from generally thin sheet material.

5. The centrifuge of claim 2 wherein each of said vanes comprises a radial outer portion extending in a generally radial plane about said common axis.

6. The centrifuge of claim 5 wherein each of said vanes further comprises a radial inner portion extending in a generally circumferential direction about said common axis.

7. The centrifuge of claim 6 wherein the radial inner portion of each vane extends to its respective outlet in a circumferential direction generally opposite to the direction of rotation of the bowl.

8. The centrifuge of claim 7 wherein each set of adjacent vanes is so configured and arranged that the cross-sectional area of the passageway defined by the vanes at the radial outer portion of these adjacent vanes is greater than that at the radial inner portion thereof.

9. The centrifuge of claim 8 wherein the cross-sectional area for fluid flow in the passageways at their respective outlet is so sized that the vanes direct the overflow liquid to flow at an angular velocity relative to the bowl approximately equal in magnitude but opposite in direction to the angular velocity of the bowl at the outlets.

10. The centrifuge of claim 1 further comprises a plurality of said liquid transfer ports in the bowl-head at substantially the same radial distance from said common axis.

* * * * *